US006281768B1

(12) United States Patent
Tada et al.

(10) Patent No.: US 6,281,768 B1
(45) Date of Patent: Aug. 28, 2001

(54) DIELECTRIC FILTER, DUPLEXER, AND COMMUNICATION APPARATUS

(75) Inventors: Hitoshi Tada; Motoharu Hiroshima; Hideyuki Kato, all of Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/439,891

(22) Filed: Nov. 12, 1999

(30) Foreign Application Priority Data

Nov. 13, 1998 (JP) ..... 10-323392
Oct. 13, 1999 (JP) ..... 11-291574

(51) Int. Cl.[7] ..... H01P 1/20; H01P 5/12
(52) U.S. Cl. ..... 333/206; 333/202; 333/134
(58) Field of Search ..... 333/202, 203, 333/206, 134

(56) References Cited

U.S. PATENT DOCUMENTS 4,757,284 * 7/1988 Ueno ..... 333/203
6,147,575 * 11/2000 Hirstauka et al. ..... 333/202

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

There is disclosed a dielectric filter comprising: a plurality of resonant lines disposed in a dielectric block, in a dielectric substrate, or on a dielectric substrate; wherein the open ends of at least one adjacent pair of the resonant lines are oriented in the same direction to be combline-coupled, a first trap resonator resonant line and a signal inputting/outputting excitation line are each interdigitally coupled to one of the plurality of resonant lines, and a second trap-resonator resonant line is interdigitally coupled to the excitation line.

4 Claims, 9 Drawing Sheets

FIG. 4D
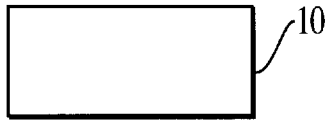
FIG. 4B
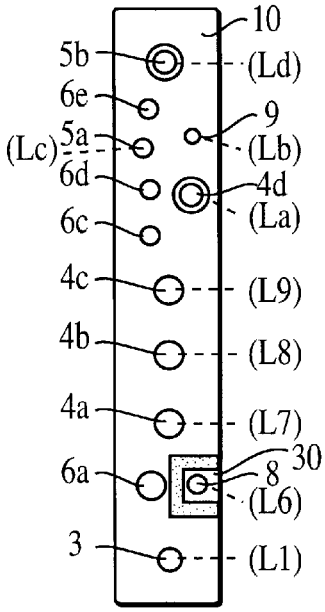
FIG. 4A
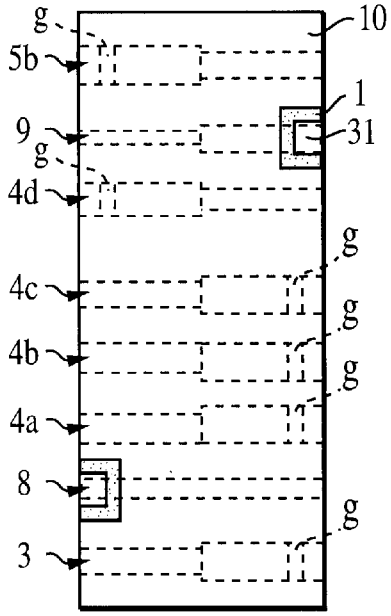
FIG. 4C
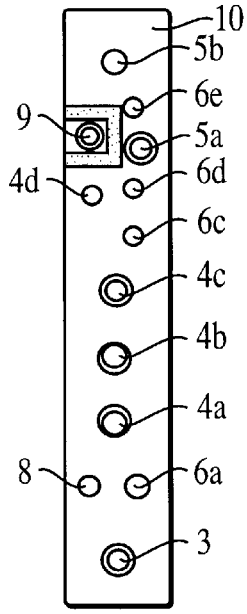
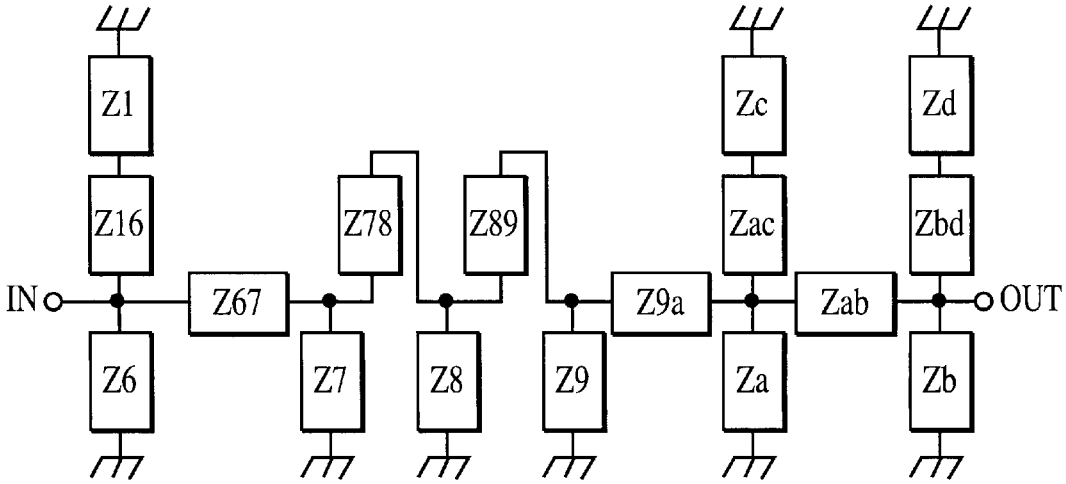
FIG. 5

FIG. 7A
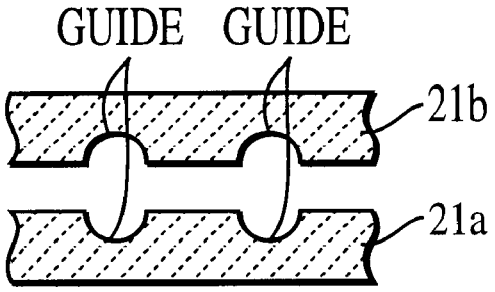
FIG. 7B
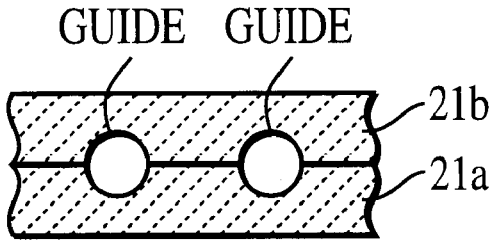
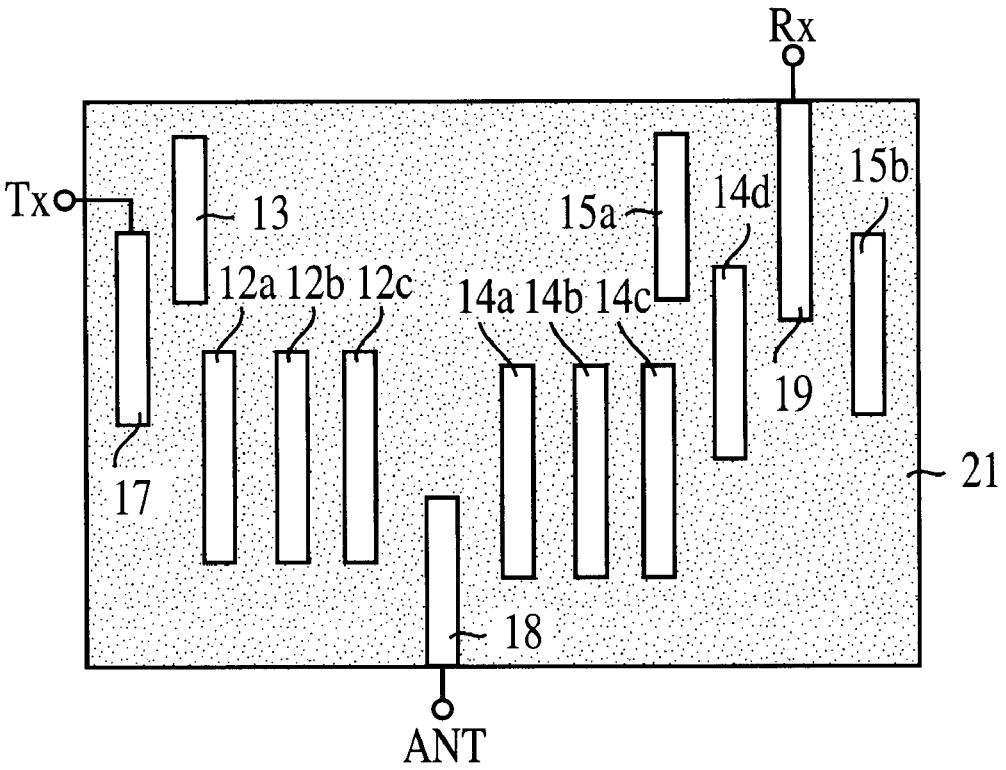
FIG. 8

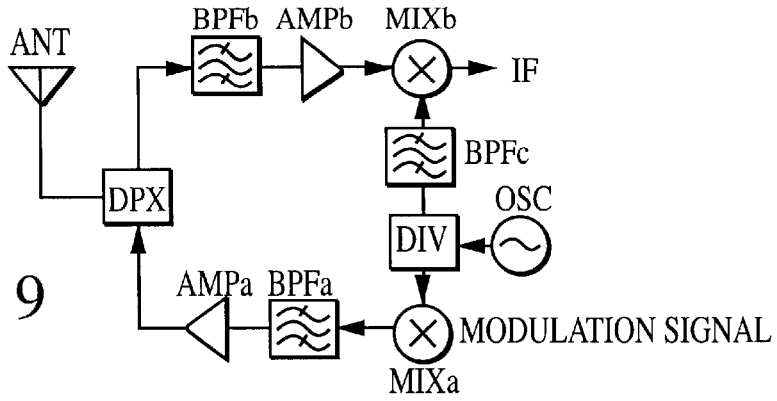
FIG. 9
FIG. 10D
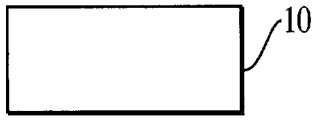
FIG. 10B
PRIOR ART
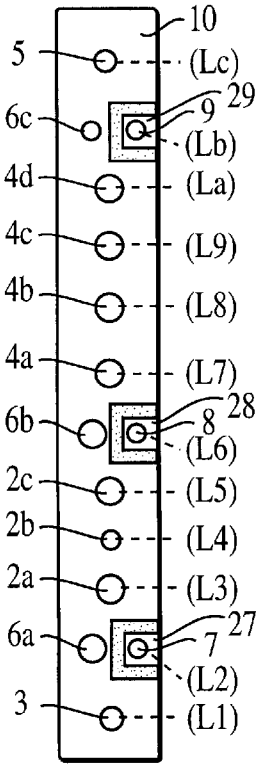
FIG. 10A
PRIOR ART
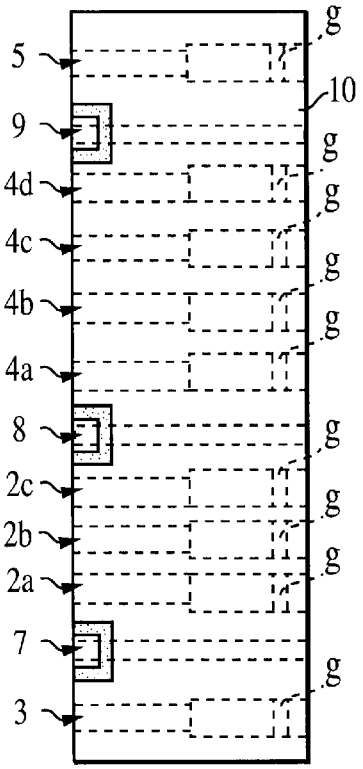
FIG. 10C
PRIOR ART
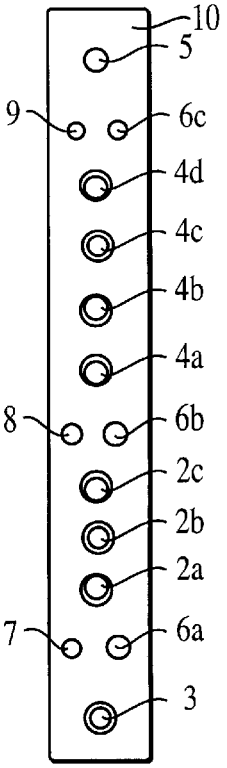

DIELECTRIC FILTER, DUPLEXER, AND COMMUNICATION APPARATUS

BACKGROUND OF THE INVENTION

1. Field of the Invention

The present invention relates to a dielectric filter, a duplexer, and a communication apparatus incorporating the same, which are used in a high-frequency circuit.

2. Description of the Related Art

Dielectric filters having both band-pass characteristics and band-stop characteristics obtained by a plurality of resonant lines disposed in a dielectric block are disclosed in (1) Japanese Unexamined Patent Publication No. 8-32313 and (2) Japanese Unexamined Patent Publication No. 8-330806. In each of the dielectric filters, the plurality of resonant lines are combline-coupled in the dielectric block to obtain band-pass characteristics, and in addition, there is provide a trap resonator to form an attenuation pole.

FIGS. 10A to 10D show an example of a duplexer using the conventional art. FIGS. 10A to 10D are projection views of the duplexer, in which FIG. 10A is a front view, FIG. 10B is a left side view, FIG. 10C is a right side view, and FIG. 10D is a top view.

In this duplexer, holes and electrodes are formed with respect to a rectangular-parallelepiped dielectric block 1. Reference numerals 2 (2*a*, 2*b*, and 2*c*), 3, 4, (4*a*, 4*b*, 4*c*, and 4*d*), and 5 denote resonant-line holes, inside of which inner conductors are disposed to form resonant lines. Reference numerals 7, 8, and 9 denote excitation-line holes, inside of which inner conductors are disposed to form excitation lines. Reference numerals L1, L2 to Ld shown in the figure indicate serial numbers given to the above-mentioned lines in order to be referred to in an equivalent circuit shown below.

FIG. 11 is an equivalent circuit diagram of the duplexer shown in FIG. 10. In this figure, since Z12 acts a phase circuit of $\pi/2$ [rad] (hereinafter indicated by omitting the rad as a unit of a phase angle), (Z1 and Z12) act as trap resonators. Z3, Z4, and Z5 act as a three-stage resonator in which they are combline-coupled in sequence. Similarly, Z7, Z8, Z9, and Za act as a four-stage resonator in which they are combline-coupled in sequence. Additionally, since Zbc acts as a $\pi/2$ phase circuit, (Zc and Zbc) act as trap resonators.

FIG. 12 shows the pass characteristics of the duplexer described above. In this figure, the upper graph shows the pass characteristics of a reception filter, and the lower graph shows those of a transmitting filter. In the reception filter, signals of the receiving frequency band are allowed to pass through, whereas signals of the transmitting frequency band are attenuated, and in the transmitting filter, signals of the transmitting frequency band are allowed to pass through, whereas signals of the receiving frequency band are attenuated.

However, in the dielectric filters in accordance with the conventional art described in (1) and (2), although attenuation characteristics can be obtained by a polarity generated due to the coupling circuit of combline coupling and the single trap resonator, the depth (the amount of attenuation) of the polarity obtained by the coupling circuit cannot be changed. In addition, in order to bring the position of the polarity close to a pass band, it is necessary to narrow the pitch between the resonators (the distance between the resonant-line holes). However, if it is narrowed, Qo of the resonators is deteriorated.

Furthermore, in the dielectric filter according to the conventional art, the initial-stage or final-stage resonant line of the resonant lines being combline-coupled is coupled to the excitation line to obtain an external coupling, and the trap-resonator resonant line is adjacent to the excitation line, with the result that only a single attenuation pole can be obtained by the trap resonator.

SUMMARY OF THE INVENTION

To overcome the above described problems, one preferred embodiments of the present invention provides a dielectric filter comprising: a plurality of resonant lines disposed in a dielectric block, in a dielectric substrate, or on a dielectric substrate; wherein the open ends of at least one adjacent pair of the resonant lines are oriented in the same direction to be combline-coupled, a first trap-resonator resonant line and a signal inputting/outputting excitation line are each interdigitally coupled to one of the plurality of resonant lines, and a second trap-resonator resonant line is interdigitally coupled to the excitation line.

In this way, the adjacent specified ones of the plurality of resonant lines disposed in the dielectric block, the dielectric substrate, or on the dielectric substrate are combline-coupled, and at the part of the combline-coupling, band-pass filter characteristics are generated. In addition, the one of the plurality of resonant lines and the first trap-resonator resonant line are interdigitally coupled to produce a first attenuation pole, and the signal inputting/outputting excitation line and the second trap-resonator resonant line are interdigitally coupled to produce a second attenuation pole. Producing the first and second attenuation poles permits signals of a relatively wide frequency band to be largely attenuated, which leads to great improvement in the attenuation characteristics of the low-frequency side or high-frequency side in the pass band. In addition, since there is no influence of the pitch between resonators, widening the pitch between resonators can increase Qo, which leads to sufficient suppression of the insertion losses in the pass band.

Another preferred embodiment of the present invention provides a duplexer comprising a transmitting filter and a reception filter constituted of a plurality of resonant lines disposed in a dielectric block, in a dielectric substrate, or on a dielectric substrate, at least one adjacent pair of the resonant lines being mutually coupled, wherein trap-resonator resonant lines are disposed to be interdigitally coupled to the final-stage resonant line of the reception filter and an excitation line coupled thereto or the initial-stage resonant line of the transmitting filter and an excitation line coupled thereto.

In this arrangement, the trap-resonator resonant lines for being interdigitally coupled to both the final-stage resonant line of the reception filter and the excitation line coupled to the resonant line are disposed so as to obtain reception filter characteristics having attenuation poles produced by the two trap-resonator resonant lines. In addition, the trap-resonator resonant lines for being each interdigitally coupled to both the initial-stage resonant line of the transmitting filter and the excitation line coupled to the resonant line are disposed so as to obtain transmitting-filter characteristics having attenuation poles produced by the two trap-resonator resonant lines. This permits the characteristics of the reception filter significantly attenuating the signals of the transmitting-frequency band to be easily obtained, and also permits the transmitting filter significantly attenuating the signals of the receiving-frequency band to be easily obtained.

That is, a duplexer can be produced where one of the transmitting filter and the reception filter or both of them having characteristics which significantly attenuate the frequency band of the counterpart filter.

Yet another preferred embodiment of the invention provides a communication apparatus by forming the dielectric filter or the duplexer described above in a high-frequency circuit section.

Using a compact filter or duplexer capable of passing the signals of a desired frequency band with low insertion losses to greatly attenuate the signals of the stopping frequency band permits a compact communication apparatus having an excellent high-frequency circuit characteristic to be produced.

Other features and advantages of the present invention will become apparent from the following description of the invention which refers to the accompanying drawings.

BRIEF DESCRIPTION OF DRAWINGS

FIGS. 4A, 4B, 4C and 4D are projection views of a dielectric filter according to a second embodiment of the invention.

FIG. 5 is an equivalent circuit diagram of the dielectric filter.

FIGS. 7A and 7B are sectional views showing a structure of lines according to a fourth embodiment of the invention.

FIG. 8 is a plan view of a duplexer according to a fifth embodiment of the invention.

FIG. 9 is a block diagram of a high-frequency circuit section used in a communication apparatus according to a sixth embodiment of the invention.

FIGS. 10A, 10B, 10C and 10D are projection views of a conventional duplexer.

DESCRIPTION OF PREFERRED EMBODIMENTS

Figure 1D:
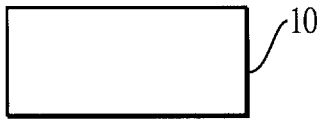
FIGS. 1A, 1B, 1C and 1D are projection views of a duplexer according to a first embodiment of the present invention.
Figure 1B:
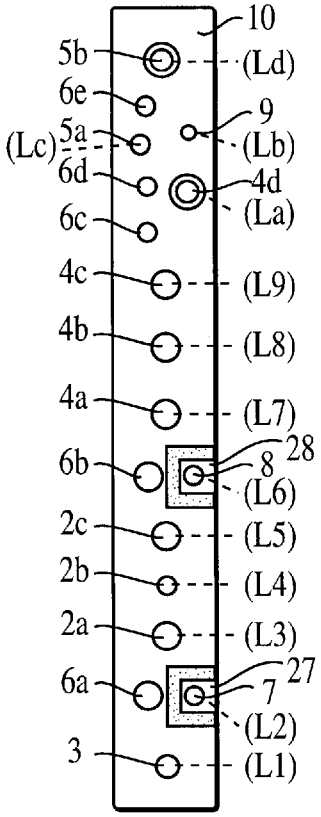
Figure 1A:
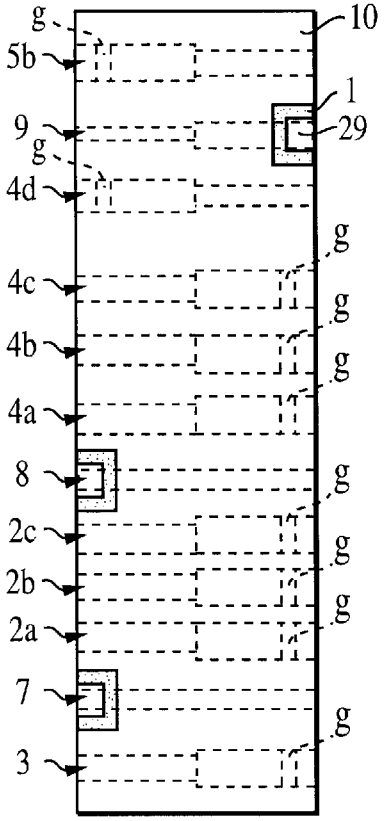
Figure 1C:
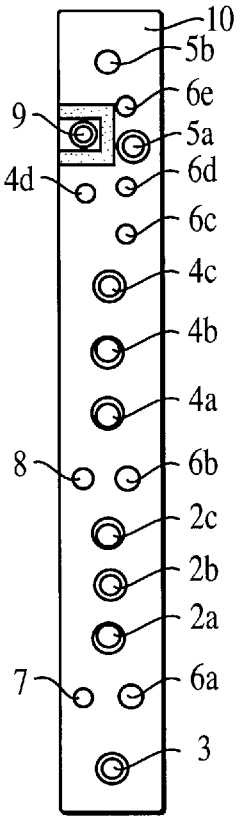
Figure 2:
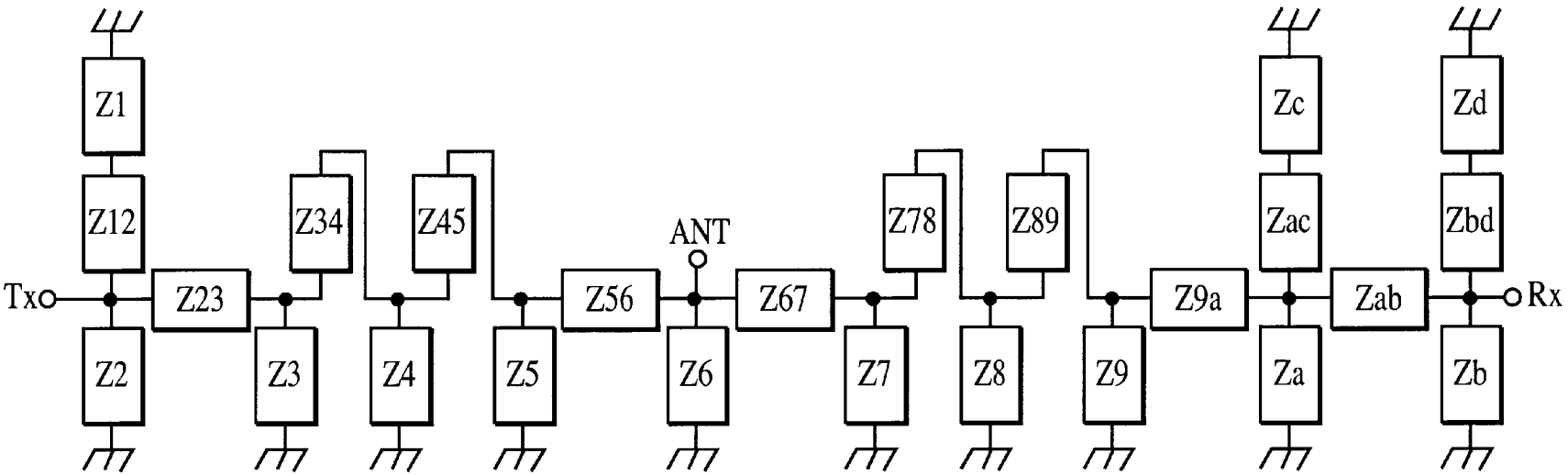
FIG. 2 is an equivalent circuit diagram of the duplexer.
Figure 3A:
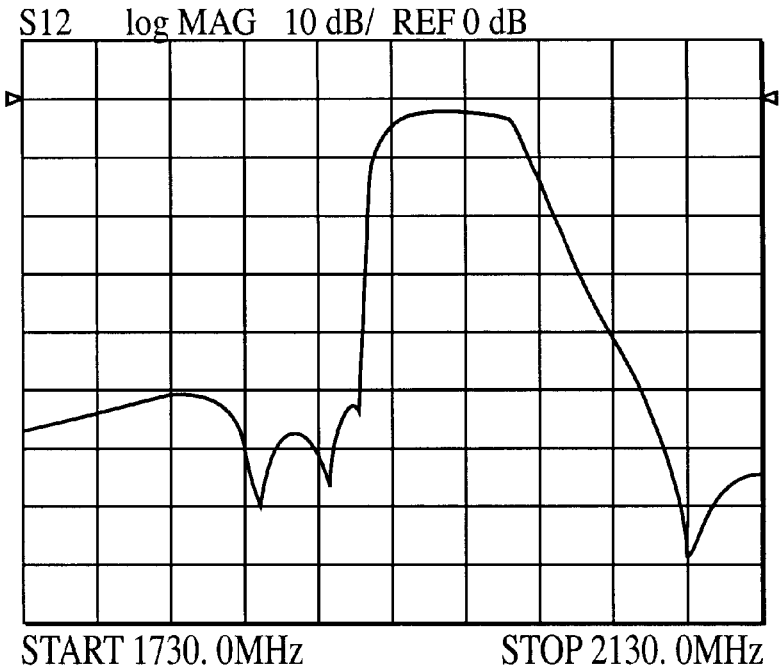
FIG. 3 shows the pass-characteristic views of the reception filter and the transmitting filter used in the duplexer.
Figure 3B:
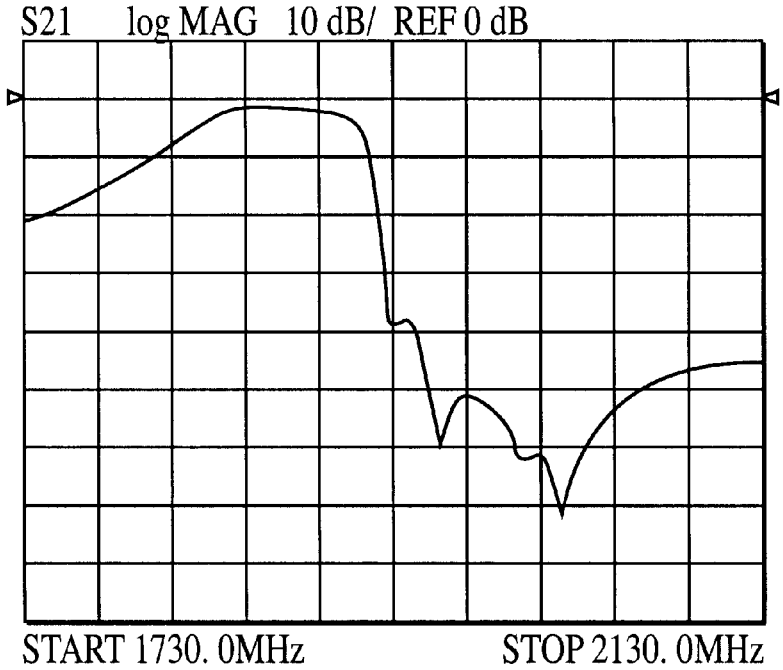

A structure of a duplexer according to a first embodiment of the present invention will be illustrated referring to FIGS. 1 to 3.

FIGS. 1A to 1D are projection views of the duplexer, in which FIG. 1A is a front view, FIG. 1B is a left side view, FIG. 1C is a right side view, and FIG. 1D is a top view. The front side shown in FIG. 1A is a surface for mounting the duplexer on a printed circuit board.

In this duplexer, holes and electrodes are formed with respect to a rectangular-parallelepiped dielectric block 1. Reference numerals 2 (2*a,* 2*b,* and 2*c*), 3, 4 (4*a,* 4*b,* 4*c,* and 4*d*), 5 (5*a* and 5*b*) denote resonant-line holes, inside of which inner conductors are disposed to resonant lines. Reference numerals 7, 8, and 9 denote excitation-line holes, inside of which inner conductors are disposed to form excitation lines. Inside of the resonant-line holes, electrodeless portions indicated by the symbol g are disposed to form open ends inside the holes. Reference numerals L1, L2 to Ld in the figure are series numbers given to the above-mentioned lines for being referred to in an equivalent circuit described below.

Reference numerals 6 (6*a,* 6*b,* 6*c,* 6*d,* and 6*e*) denote earth holes, the entire inner surfaces of which are disposed inner conductors. On the outer surface of the dielectric block 1, an outer conductor 10 is disposed in the region except terminal electrodes, which will be described below. The inner conductors of the earth holes 6 are electrically connected to the outer conductors of opposing both ends of the dielectric block 1.

A transmitting terminal electrode 27 is disposed at one end of the excitation-line hole 7. One end of the inner conductor of the excitation-line hole 7 is electrically connected to the transmitting terminal electrode 27, and the other end thereof is electrically connected to the outer conductor 10. An antenna terminal electrode 28 is disposed at one end of the excitation-line hole 8. One end of the inner conductor of the excitation-line hole 8 is electrically connected to the antenna terminal electrode 28, and the other end thereof is electrically connected to the outer conductor 10. Similarly, a receiving terminal electrode 29 is disposed at one end of the excitation-line hole 9. One end of the inner conductor of the excitation-line hole 9 is electrically connected to the receiving terminal electrode 29, and the other end thereof is electrically connected to the outer conductor 10.

The operation of the duplexer having such a structure will be described as follows. First, the open ends of the resonant lines formed in the resonant-line holes 2*a,* 2*b,* and 2*c* are oriented in the same direction to be combline-coupled. The resonant line formed in the resonant-line hole 2*c* and the excitation line formed in the excitation-line hole 8 are interdigitally coupled. In addition, the resonant line formed in the resonant-line hole 2*a* and the excitation line formed in the excitation-line hole 7 are interdigitally coupled. Furthermore, the resonant line formed in the resonant-line hole 3 and the excitation line formed in the excitation-line hole 7 are interdigitally coupled. The earth hole 6*a* cuts off the coupling between the resonant lines of the resonant-line holes 3 and 2*a*. This allows the part between the transmitting terminal electrode 27 and the antenna terminal electrode 28 to serve as a transmitting filter having a single attenuation pole while passing the signals of a specified frequency band.

Furthermore, the open ends of the resonant lines of the resonant-line holes 4*a,* 4*b,* and 4*c* are oriented in the same direction to be combline-coupled. The resonant line of the resonant-line hole 4*c* and the resonant line of the resonant-line hole 4*d* are interdigitally coupled. The four resonant lines form a four-stage resonator so as to obtain a band-pass filter characteristic. The resonant line of the resonant-line hole 4*d* and the resonant line of the resonant-line hole 5*a* are interdigitally coupled. In addition to these, the resonant line of the resonant-line hole 4*d* and the excitation line of the excitation-line hole 9 are interdigitally coupled. The earth holes 6*c* and 6*d* cut off the coupling between the resonant lines of the resonant-line holes 4*c* and 5*a,* and the earth hole 6*e* cuts off the coupling between the resonant lines of the resonant-line holes 5*a* and 5*b*. In this arrangement, the resonant line of the fourth-stage resonant-line hole 4*d* and the excitation line of the excitation-line hole 9 form a $\pi/2$ phase circuit, and the respective resonant lines of the resonant-line holes 5*a* and 5*b* serve as trap resonators, in which the two trap resonators are phase-coupled at $\pi/2$. Therefore, the part between the antenna terminal electrode 28 and the receiving terminal electrode 29 serves as a reception filter having attenuation poles produced by the two trap resonators while passing the signals of a specified frequency band.

FIG. 2 is an equivalent circuit diagram of the duplexer shown in FIG. 1. In this figure, reference numerals such as Z1, Z2, and the like, correspond to the series numbers of the lines shown in FIG. 1. For example, reference numeral Z1 corresponds to the line L1 shown in FIG. 1 and the reference numeral Z2 corresponds to the line L2 shown in FIG. 1. In addition, impedance indicated by giving a one-digit number such as Z1 and Z2 is impedance of the self capacity of the resonant line and the excitation line, and impedance indicated by giving a two-digit number such as Z12 and Z23 is impedance of the mutual capacity generated between the coupled resonant lines or between the resonant line and the excitation line. For example, reference numeral Z12 corresponds to the mutual capacity between the lines L1 and L2, and reference numeral Z23 corresponds to the mutual capacity between the lines L2 and L3.

In this situation, when the self capacity of the resonator is represented by the symbol Ci, the mutual capacity of the resonator is represented by the symbol Cij, the relative permittivity of the dielectric block is represented by the symbol $\epsilon r$, and the velocity of light is represented by the symbol vc, the following equations are generally obtained.

$$Zi=\sqrt{(\epsilon r)}/(vc\cdot Ci)$$

$$Zij=\sqrt{(\epsilon r)}/(vc\cdot Cij)$$

In FIG. 2, Z12 acts as a $\pi/2$ phase circuit, and (Z1 and Z12) thereby act as trap resonators. Z3, Z4, and Z5 act as a three-stage resonator, in which they are combline-coupled in sequence. Z7, Z8, Z9, and Za act as a four-stage resonator in which they are coupled in sequence. In addition, since each of Zac and Zbd acts as a phase circuit of an electric length $\pi/2$ at a frequency which produces each attenuation pole, (Zc and Zac) and (Zd and Zbd) act as trap resonators. Since Zab acts as a $\pi/2$ phase circuit between the trap resonators, there is provided a structure in which the two trap resonators are connected to the reception filter.

FIG. 3 shows the pass characteristics of the duplexer. The upper graph shows the pass characteristics of the reception filter, and the lower graph shows the pass characteristics of the transmitting filter. This is an example of a communication system in which the low-frequency side is used as a transmitting frequency band and the high-frequency side is used as a receiving frequency band. In the reception filter, the signals of the receiving frequency band are passed, and the signals of the lower-frequency side, which is the transmitting frequency band, are attenuated by the two attenuation poles. This characteristic makes the attenuation curve of the lower-frequency side of the pass band steep and increases the attenuation in the transmitting frequency band, with the result that interference with the receiving circuit caused by the signals of the transmitting-frequency band can sufficiently be suppressed.

In the present invention, since there is no need to dispose an attenuation pole by the polarity of the coupling circuit as describe above, for example, in order to bring the attenuation-pole frequency close to a pass band, it is unnecessary to narrow the pitch between the resonators (the distance between the resonance-line holes). Accordingly, widening the pitch between the resonators permits Qo (Qodd) to be greatly improved, and insertion-loss characteristics can thereby be improved.

In the first embodiment, although the two trap resonators are disposed in the reception filter, the trap resonators can also be disposed in the transmitting filter. More specifically, it is possible to dispose trap-resonator resonant lines, which are interdigitally coupled to the excitation line coupled to the initial-stage resonant line of the transmitting filter and the resonant line.

Next, a structure of a dielectric filter in accordance with a second embodiment of the present invention will be illustrated referring to FIGS. 4A to 4B and 5.

Regarding the dielectric filter, the reception filter of the duplexer shown in FIG. 1 is taken out, and to the input-end side of the filter, another trap resonator is added. More specifically, in the dielectric filter, a plurality of holes and electrodes is disposed in a rectangular parallelepiped dielectric block 1. Reference numerals 3, 4 (4*a*, 4*b*, 4*c*, and 4*d*), 5 (5*a* and 5*b*) denote resonant-line holes, inside of which inner conductors are disposed to form resonant lines. Reference numerals 8 and 9 denote excitation-line holes, inside of which inner conductors are disposed to form excitation lines. Inside of the resonant-line holes, electrodeless portions indicated by the symbol g are disposed to form open ends. In addition, reference numeral 6 (6*a*, 6*c*, 6*d*, and 6*e*) denote earth holes, on the entire inner surfaces of which inner conductors are disposed. On the external surface of the dielectric block 1, an outer conductor 10 is disposed on the region except terminal electrodes. The inner conductors of the earth holes 6 are electrically connected to the outer conductors at the opposing ends of the dielectric block 1.

An input terminal electrode 30 is disposed at one end of the excitation-line hole 8. One end of the inner conductor of the excitation-line hole 8 is electrically connected to the input terminal electrode 30, and the other end thereof is electrically connected to the outer conductor 10. Similarly, an output terminal electrode 31 is disposed at one end of an excitation-line hole 9. One end of the inner conductor of the excitation-line hole 9 is electrically connected to the output terminal electrode 31, and the other end thereof is electrically connected to the outer conductor.

FIG. 5 is an equivalent circuit diagram of the dielectric filter shown in FIGS. 4A to 4D. Each line indicated by the symbol of impedance is the equivalent to that in the case of the first embodiment. In FIG. 5, since Z16 serves as a $\pi/2$ phase circuit, (Z1 and Z16) serve as trap resonators. The parts of Z7 to Za serve as a four-stage resonator in which they are sequentially coupled. The structure of the output side (the right side in the figure) from Z9a is the same as that in the case of the first embodiment. Thus, the dielectric filter has a structure in which a total of three trap resonators are connected to a reception filter. When the resonant frequencies of these trap resonators are appropriately set, a band pass filter can be obtained where frequency signals of the high-frequency side or low-frequency side of the pass band or both sides thereof are steeply attenuated.

Next, the structure of a dielectric filter in accordance with a third embodiment will be illustrated referring to FIGS. 6A to 6D.

Although the first and second embodiments adopt the arrangement in which the outer conductor is disposed on the open surfaces of the resonant-line holes of the dielectric block, and inside of the resonant-line holes, the electrodeless portions are disposed to form open ends inside the holes, the third embodiment has an arrangement such that the open end of each resonant line is disposed on the open surface of each resonant-line hole of a dielectric block. Furthermore, in the first and second embodiments, the excitation lines are disposed to be coupled to the resonant lines. In the third embodiment, however, terminal electrodes are formed on the outer surface of the dielectric block to be coupled to the resonant lines.

Figure 6D:
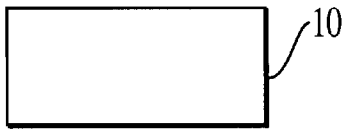
FIGS. 6A, 6B, 6C and 6D are projection views of a dielectric filter according to a third embodiment of the invention.
Figure 6B:
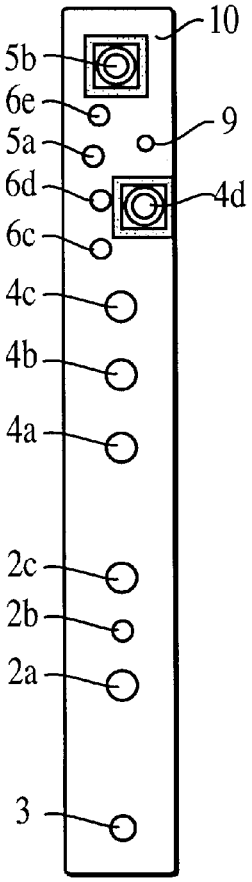
Figure 6A:
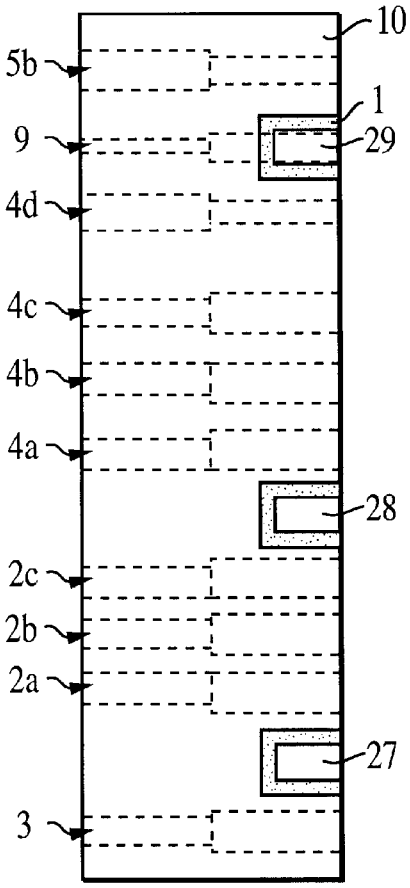
Figure 6C:
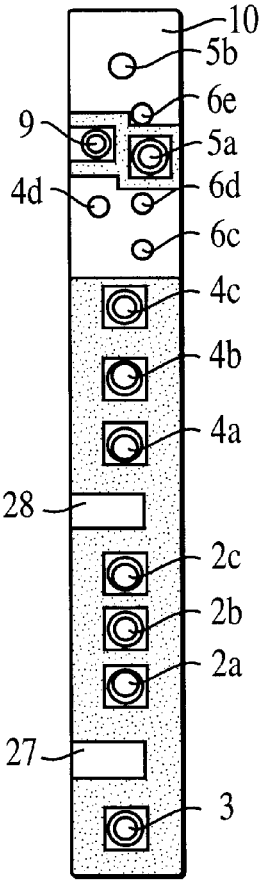
Figure 11:
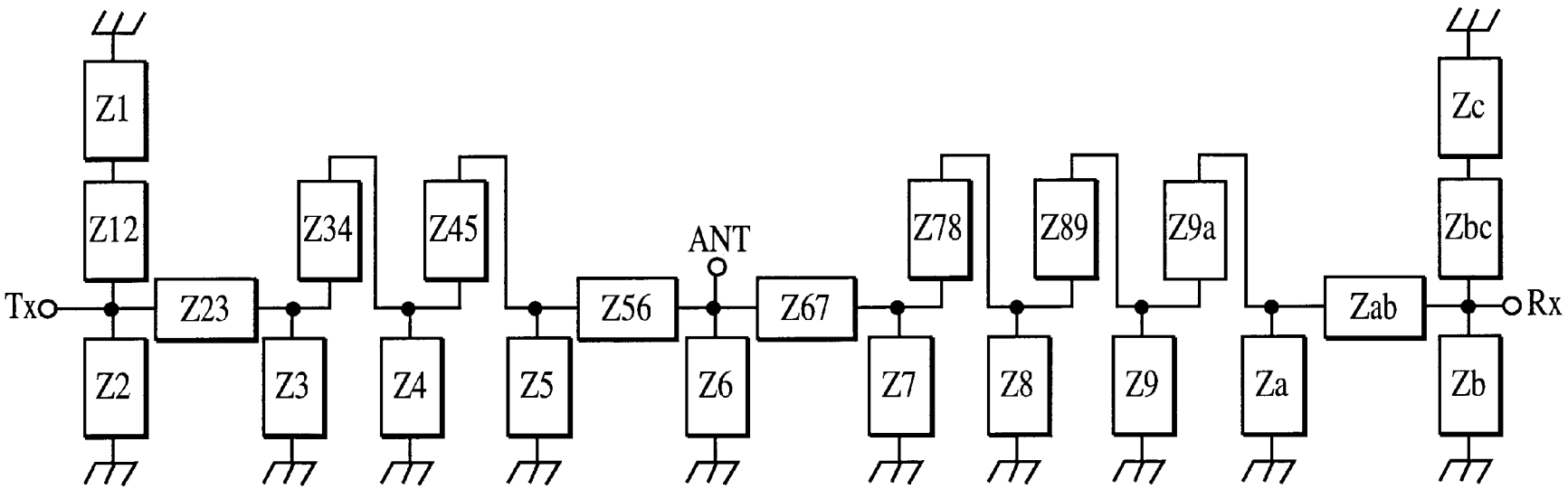
FIG. 11 PRIOR ART
FIG. 11 is an equivalent circuit diagram of the conventional duplexer.
Figure 12A:
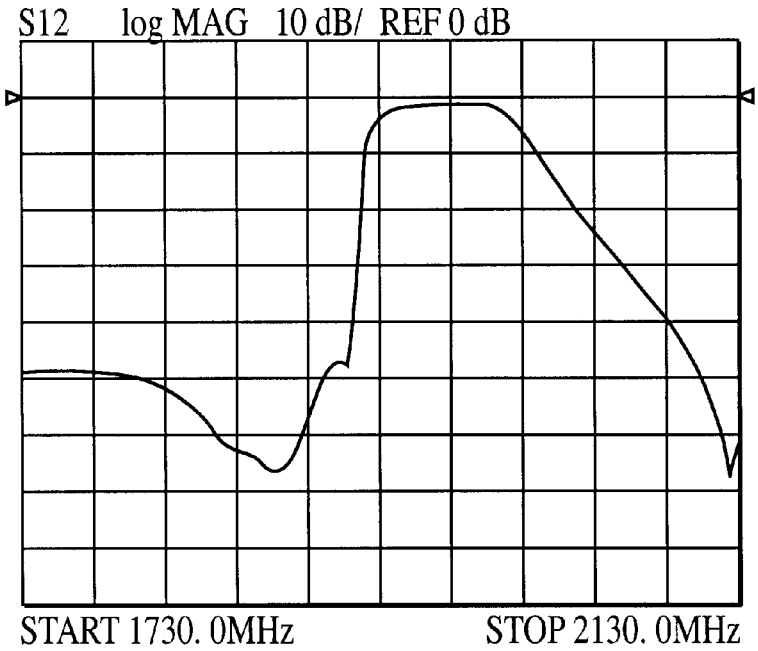
FIG. 12A PRIOR ART
FIG. 12 is a pass-characteristic view of the conventional duplexer.
Figure 12B:
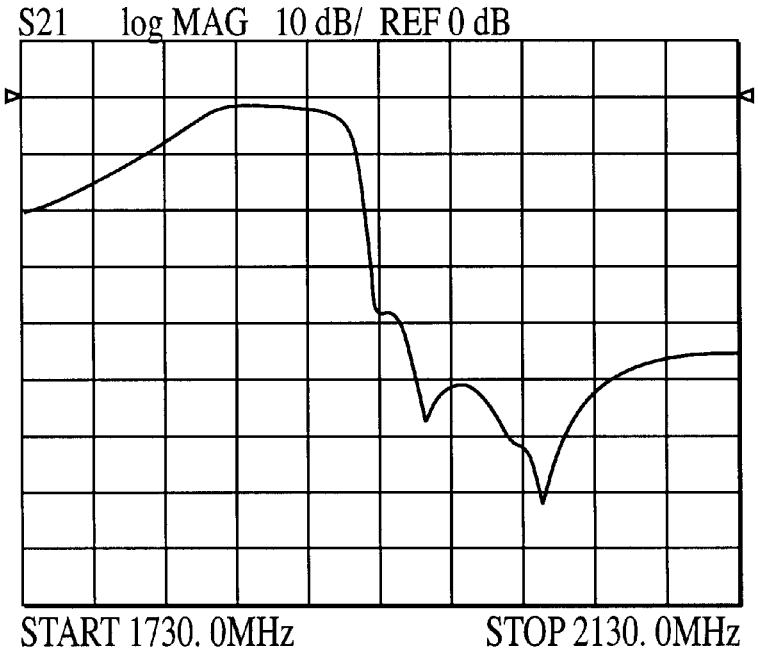
FIG. 12B PRIOR ART

FIGS. 6A to 6B are projection views of a duplexer in accordance with the third embodiment, in which FIG. 6A is a front view, FIG. 6B is a left side view, FIG. 6C is a right side view, and FIG. 6D is a top view. The front side shown in FIG. 6A is the surface for being mounted on a printed circuit board.

In this duplexer, holes and electrodes are formed with respect to a rectangular parallelepiped dielectric block 1. Reference numerals 2 (2*a,* 2*b,* and 2*c*), 3, 4 (4*a,* 4*b,* 4*c,* and 4*d*), 5 (5*a* and 5*b*) denote resonant-line holes, inside of which inner conductors are disposed to form resonant lines. Referential numeral 9 denotes an excitation-line hole, inside of which an inner conductor is disposed to form an excitation line. On the outer surface of the dielectric block 1, an outer conductor 10 is disposed in the region excepting the parts of open-end electrodes and terminal electrodes, which will be described below. In this arrangement, each one end of the resonant-line holes and each one end of the excitation-line holes are the short-circuited ends of the resonant lines and the excitation lines. In addition, on the open surface of the other end of each resonant-line hole, an open-end electrode extending in a quadrangular form is disposed.

Reference numerals 6 (6*c,* 6*d,* and 6*e*) denote earth holes, on the entire inner surfaces of which inner conductors are disposed. The inner conductors of the earth holes 6 are electrically connected to the outer conductors at the opposing ends of the dielectric block 1.

Reference numeral 27 denotes a transmitting terminal electrode, which is disposed near the openings on the open-end sides of the resonant-line holes 2*a* and 3. Reference numeral 28 is an antenna terminal electrode, which is disposed near the openings on the open-end sides of the resonant-line holes 2*c* and 4*a*. A receiving terminal electrode 29 is disposed at one end of the excitation-line hole 9, and one end of the inner conductor of the excitation-line hole 9 is electrically connected to the receiving terminal electrode 29.

Basically, the operation of the duplexer having such a structure is the same as that shown in the first embodiment. More specifically, the resonant lines formed inside the resonant-line holes 2*a,* 2*b,* and 2*c* are coupled by the capacitance between the open-end electrodes of the respective resonant lines. The resonant lines formed inside the resonant-line holes 2*a* and 3 and the transmitting terminal electrode 27 are coupled by the capacitance between them. Similarly, the resonant lines formed inside the resonant-line holes 2*c* and 4*a* and the antenna terminal electrode 28 are coupled by the capacitance between them. In this arrangement, the part between the transmitting terminal electrode 27 and the antenna terminal electrode 28 serves as a transmitting filter having a single attenuation pole which allowing the signals of a specified frequency band to pass through.

Furthermore, the resonant lines of the resonant-line holes 4*a,* 4*b,* and 4*c* are coupled by the capacitance between the open-end electrodes of the resonant lines. The operations of the resonant-line holes 4*c,* 4*d,* 5*a,* 5*b,* and the earth holes 6*c* and 6*e* are the same as those in the first embodiment shown in FIG. 1. Under this situation, the resonant line of the fourth-stage resonant-line hole 4*d* and the excitation line of the excitation-line hole 9 form a $\pi/2$ phase circuit, the resonant lines of the resonant-line holes 5*a* and 5*b* serve as trap resonators, in which the two trap resonators are phase-coupled at $\pi/2$. As a result, the part between the receiving terminal electrode 29 and the antenna terminal electrode 28 serves as a reception filter having attenuation poles produced by the two trap resonators while passing the signals of a specified frequency band.

In the embodiments described above, holes are formed in the rectangular parallelepiped dielectric block and inside of the holes are disposed inner conductors to form the resonant lines, the excitation lines, and the earth lines. Alternatively, these lines can be formed by laminating dielectric substrates. FIGS. 7A and 7B show sectional views of the lines in an example using such an arrangement. FIG. 7A is a sectional view of two sheets of dielectric substrates before lamination, and FIG. 7B is a sectional view thereof after lamination. Under this situation, lines are formed in the dielectric substrate by forming grooves in dielectric substrates 21*a* and 21*b* to dispose inner conductors on the inner surfaces of the grooves and laminate the two dielectric substrates 21*a* and 21*b*.

The resonant lines, the excitation lines, and the earth lines may be formed on the dielectric substrate. FIG. 8 shows an example of a duplexer using the arrangement. In FIG. 8, reference numeral 21 denotes a dielectric substrate, on which are formed resonant lines 12*a,* 12*b,* 12*c,* 13*a,* 14*a,* 14*b,* 14*c,* 14*d,* 15*a,* and 15*b*. In addition, excitation lines 17, 18, and 19 are also formed thereon. In this case, the resonant lines 12*a,* 12*b,* and 12*c* serve as $\lambda/2$ resonators, in which both ends of the lines are open and the lines are combline-coupled. The resonant line 12*a* and the excitation line 17 are interdigitally coupled, and the excitation line 17 and the resonant line 13 are also interdigitally coupled. Moreover, the resonant line 12*c* and the excitation line 18 are also interdigitally coupled. In this arrangement, the part between a Tx terminal and an ANT terminal exhibits characteristics in which the band-pass filter characteristics of the resonant lines 12*a,* 12*b,* and 12*c* and the band-stop filter characteristics of the trap circuit of the resonant line 13 are combined.

In FIG. 8, the resonant lines 14*a,* 14*b,* and 14*c* serve as $\lambda/2$ phase circuits, in which both ends thereof are open, and they are combline-coupled. The resonance line 14*c* and the resonant line 14*d* are interdigitally coupled, and the resonant line 14*d* and the excitation line 19 are interdigitally coupled. In addition, the resonant line 14*d* and the resonant line 15*a* are interdigitally coupled, and the excitation line 19 and the resonant line 15*b* are interdigitally coupled. In this arrangement, the part between the ANT terminal and an Rx terminal exhibits characteristics in which the band-pass filter characteristics constituted of the resonant lines 14*a,* 14*b,* and 14*c,* and 14*d* and the band-stop filter characteristics constituted of the two trap circuits of the resonant lines 15*a* and 15*b* are combined.

Next, the structure of a communication apparatus using the dielectric filter or the duplexer described above will be illustrated referring to FIG. 9. In this figure, the symbol ANT denotes a transmitting/receiving antenna, the symbol DPX denotes a duplexer, the symbols BPFa, BPFb, and BPFc denote band-pass filters, the symbols AMPa and AMPb denote amplifying circuits, the symbols MIXa and MIXb denote mixers, the symbol OSC denotes an oscillator, and the symbol DIV denotes a frequency-divider (a synthesizer). The MIXa modulates frequency signals outputted from the DIV by modulation signals, the BPFa allows the frequency signals of only the transmitting frequency band to pass through, and the AMPa power-amplifies the signals to transmit from the ANT via the DPX. The BPFb allows the signals of only the receiving frequency band among the signals outputted from the DPX to pass through and the AMPb amplifies the passed signals. The MIXb mixes the frequency signals outputted from the BPFC and the receiving signals to output intermediate-frequency signals IF.

As the duplexer DPX shown in FIG. 9, it is possible to use the duplexer of the structure shown in FIG. 1. In addition, as the band-pass filters BPFa, BPFb, and BPFc, the dielectric filter of the structure shown in FIG. 40. In this way, the size of an overall communication apparatus can be reduced.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter comprising:

a plurality of resonant lines disposed in a dielectric block, in a dielectric substrate, or on a dielectric substrate;

wherein the open ends of at least one adjacent pair of the resonant lines are oriented in the same direction to be combline-coupled, a first trap-resonator resonant line and a signal inputting/outputting excitation line are each interdigitally coupled to one of the plurality of resonant lines, and a second trap-resonator resonant line is interdigitally coupled to the excitation line.

2. A duplexer comprising a transmitting filter and a reception filter constituted of a plurality of resonant lines disposed in a dielectric block, in a dielectric substrate, or on a dielectric substrate, at least one adjacent pair of the resonant lines being mutually coupled, wherein trap-resonator resonant lines are disposed to be interdigitally coupled to the final-stage resonant line of the reception filter and an excitation line coupled thereto or the initial-stage resonant line of the transmitting filter and an excitation line coupled thereto.

3. A communication apparatus having one of the dielectric filter in accordance with claim 1 in a high-frequency circuit section thereof.

4. A communication apparatus having one of the duplexer in accordance with claim 2 in a high-frequency circuit section thereof.

* * * * *